US009576756B2

(12) United States Patent
Pizzato

(10) Patent No.: US 9,576,756 B2
(45) Date of Patent: Feb. 21, 2017

(54) SWITCH CONTROL APPARATUS FOR ELECTRIC PLANT

(71) Applicant: PIZZATO ELETTRICA SRL, Marostica (IT)

(72) Inventor: Marco Pizzato, Marostica (IT)

( * ) Notice: Subject to any disclaimer, the term of this patent is extended or adjusted under 35 U.S.C. 154(b) by 288 days.

(21) Appl. No.: 14/375,087

(22) PCT Filed: Jul. 2, 2013

(86) PCT No.: PCT/IB2013/055408
§ 371 (c)(1),
(2) Date: Jul. 28, 2014

(87) PCT Pub. No.: WO2015/001382
PCT Pub. Date: Jan. 8, 2015

(65) Prior Publication Data
US 2016/0189889 A1 Jun. 30, 2016

(51) Int. Cl.

| | |
|---|---|
| ***H01H 9/00*** | (2006.01) |
| ***H01H 13/00*** | (2006.01) |
| ***H01H 13/04*** | (2006.01) |
| ***H01H 3/02*** | (2006.01) |
| ***H01H 13/50*** | (2006.01) |
| ***H01H 1/58*** | (2006.01) |
| *H01H 3/60* | (2006.01) |

(52) U.S. Cl.
CPC ..... *H01H 13/04* (2013.01); *H01H 1/58* (2013.01); *H01H 3/02* (2013.01); *H01H 3/022* (2013.01); *H01H 13/503* (2013.01); *H01H 3/60* (2013.01); *H01H 2223/058* (2013.01)

(58) Field of Classification Search
CPC ..... H01H 13/04; H01H 1/58; H01H 3/02; H01H 2223/058; H01H 9/02; H01H 19/04; H01H 19/08; H01H 2223/00
USPC ..... 200/296, 303
See application file for complete search history.

(56) References Cited

U.S. PATENT DOCUMENTS 5,165,530 A * 11/1992 Shinohara ..... H01H 13/023 200/293
5,875,885 A * 3/1999 Changle ..... H02B 1/202 200/293

FOREIGN PATENT DOCUMENTS

| | | |
|---|---|---|
| DE | 8303882 | 6/1983 |
| EP | 2600368 | 6/2013 |
| EP | 2657948 | 10/2013 |
| FR | 2579694 | 10/1986 |

* cited by examiner

*Primary Examiner* — Edwin A. Leon
*Assistant Examiner* — Lheiren Mae A Caroc
(74) *Attorney, Agent, or Firm* — Themis Law

(57) ABSTRACT

A switch control apparatus for electric plants includes a box-like body which is adapted to be anchored to a fixed o movable part of an electric plant and has a closing panel with at least one passage therethrough, at least one contact unit which is accommodated in the box-like body at the passage and is adapted to be electrically connected to at least one respective electric circuit of the plant for selective open/close control thereof, at least one actuator which is adapted to interact with the contact unit for the latter to ensure selective opening/closing of the respective circuits, an anchor system for anchoring the contact unit to the actuator. The anchor system includes a container member which is adapted to enclose and contain the contact unit and to be anchored to the closing panel in the box-like body for stably securing the contact unit on the actuator.

10 Claims, 6 Drawing Sheets

SWITCH CONTROL APPARATUS FOR ELECTRIC PLANT

FIELD OF THE INVENTION

The present invention generally finds application in the field of electric control devices and particularly relates to a switch control unit for electric plants.

BACKGROUND ART

Electric switch control apparatus, such as switchboard boxes or control pushbutton stations of electric plants for handling or transportation, generally include a box-like body, which houses one or more electric switch devices designed to be connected to the electric terminals of respective electric circuits.

Particularly, switch devices include one or more switch contact units, of single- or double-contact type, each having an enclosure that contains pairs of fixed and movable contacts associated with an actuating cursor.

The latter is designed to interact with an actuator, such as a pushbutton or a selector, which is anchored to the box-like body, generally to a movable or removable part thereof.

For example, in the case of switchboards, actuators are anchored to a closing panel of the box-like body, whereas in the case of control pushbutton stations, the cover of the box is used for anchoring purposes.

As a rule, contact units are coupled to the corresponding actuators by snap fit means, allowing anchorage of one or more contact units, with the actuator portion extending from the panel into the box-like body.

Nevertheless, prior art solutions do not ensure stable anchorage of the contact units with their respective actuators, particularly if control apparatus are subjected to shocks caused by accidental falls or impacts by users.

In an attempt to at least partially obviate these drawbacks, switch control apparatus, and particularly control pushbutton stations have been proposed, which integrate additional anchor means acting upon the contact units to prevent or limit movements thereof in the box-like body.

For example, a control pushbutton station is known, which has a cage for absorbing any direct or indirect axial shock upon the contact units, by supporting such units at a bottom wall.

While a higher stability is imparted to each contact unit in this solution, only axially-directed forces may be counteracted, and no resistance is afforded to lateral stresses, whereby the risk of separation is not totally prevented.

Furthermore, as the cage is positioned, it may block the passages that are formed in the enclosure on the contact unit to allow access to the terminals of the fixed contacts and introduction of the terminals of the electric circuits, thereby adding complexity to the installation process.

A further serious drawback is that this particular type of anchor means is not adapted to pushbutton stations that allow coupling of various numbers of contact units to a single contact, which makes the entire apparatus poorly flexible.

A further prior art pushbutton station uses a protective plate located at the bottom walls of the contact units and anchored to the cover of the push-button station. The plate has such a size as to cover all the contact units at the same time, thereby preventing any separation thereof in the axial direction.

Nevertheless, once again protection is restricted, as the plate does not ensure any lateral support. Furthermore, like in the previous case, the plate covers the entire passages formed in the enclosure, and cannot accommodate any change in the number, configuration and type of contact units that can be received in the pushbutton station at the same time.

DISCLOSURE OF THE INVENTION

The present invention has the object to overcome the above drawbacks, by providing a switch control apparatus for electric plants that achieves high efficiency and relative cost effectiveness.

A particular object of the present invention is to provide a switch control apparatus for electric plants that ensures positional stability of the contact units installed therein.

A further object of the present invention is to provide a switch control apparatus for electric plants that allows easy installation and quick wiring of the contact units.

Furthermore, an object of the present invention is also to provide a switch control apparatus for electric plants that can accommodate changes in the number, configuration and type of contact units associated with each actuator, while always ensuring coupling stability.

These and other objects, as better explained hereafter, are fulfilled by a switch control apparatus for electric plants as defined in claim 1, comprising a box-like body which is adapted to be anchored to a fixed o movable part of an electric plant and has a closing panel with at least one passage therethrough, at least one contact unit which is accommodated in the box-like body at said passage and is adapted to be electrically connected to at least one respective electric circuit of the plant for selective open/close control thereof, at least one actuator which is adapted to interact with said at least one contact unit for the latter to ensure selective opening/closing of the respective circuits, anchor means for anchoring said at least one contact unit to said actuator.

The apparatus is characterized in that the anchor means comprise a container member which is adapted to envelope and contain said at least one contact unit and to be anchored to said closing panel in the box-like body for stably securing said at least one contact unit on said actuator.

With these particular features, the apparatus allows stable positioning of the contact units even in case of accidental falls of or shocks to the box/like body or the contact units themselves, as the substantially box-shaped element will absorb both axial and transverse stresses.

Advantageous embodiments of the invention are obtained in accordance with the dependent claims.

BRIEF DESCRIPTION OF THE DRAWINGS

Further characteristics and advantages of the invention will become more apparent upon reading of the following detailed description of a few preferred non-exclusive embodiments of a switch control apparatus for electric plants, which are described by way of a non-limiting example with the help of the accompanying drawings in which.

DETAILED DESCRIPTION OF A PREFERRED EMBODIMENT

Referring to the above figures, a switch apparatus is shown, which is designed to control electric plants, namely plants for handling or transportation such as, without limitation, elevators, hoists, escalators, cranes, bridge cranes, and the like.

Figure 1:
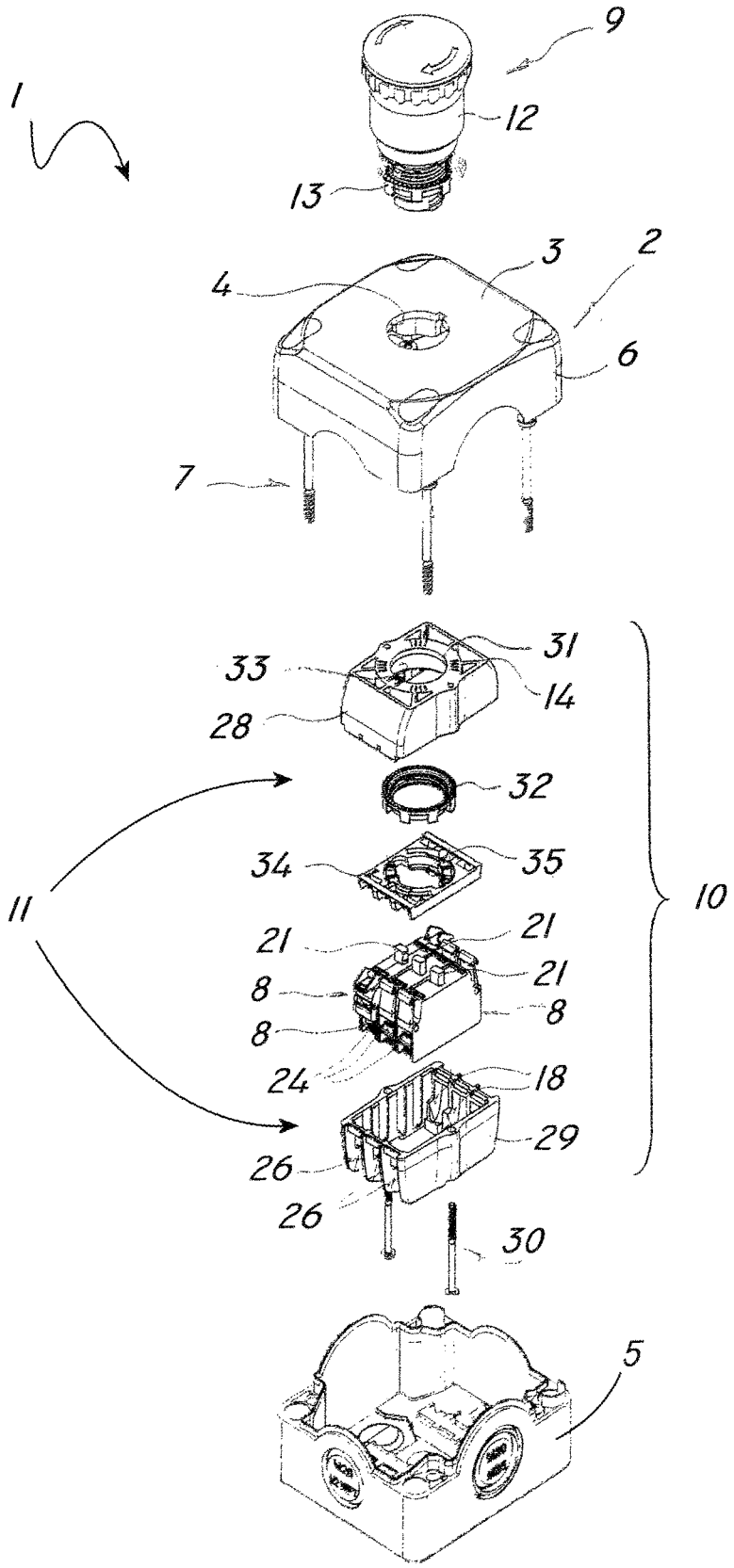
FIG. 1 is an exploded perspective view of an apparatus of the invention according to a first preferred embodiment.
Figure 2:
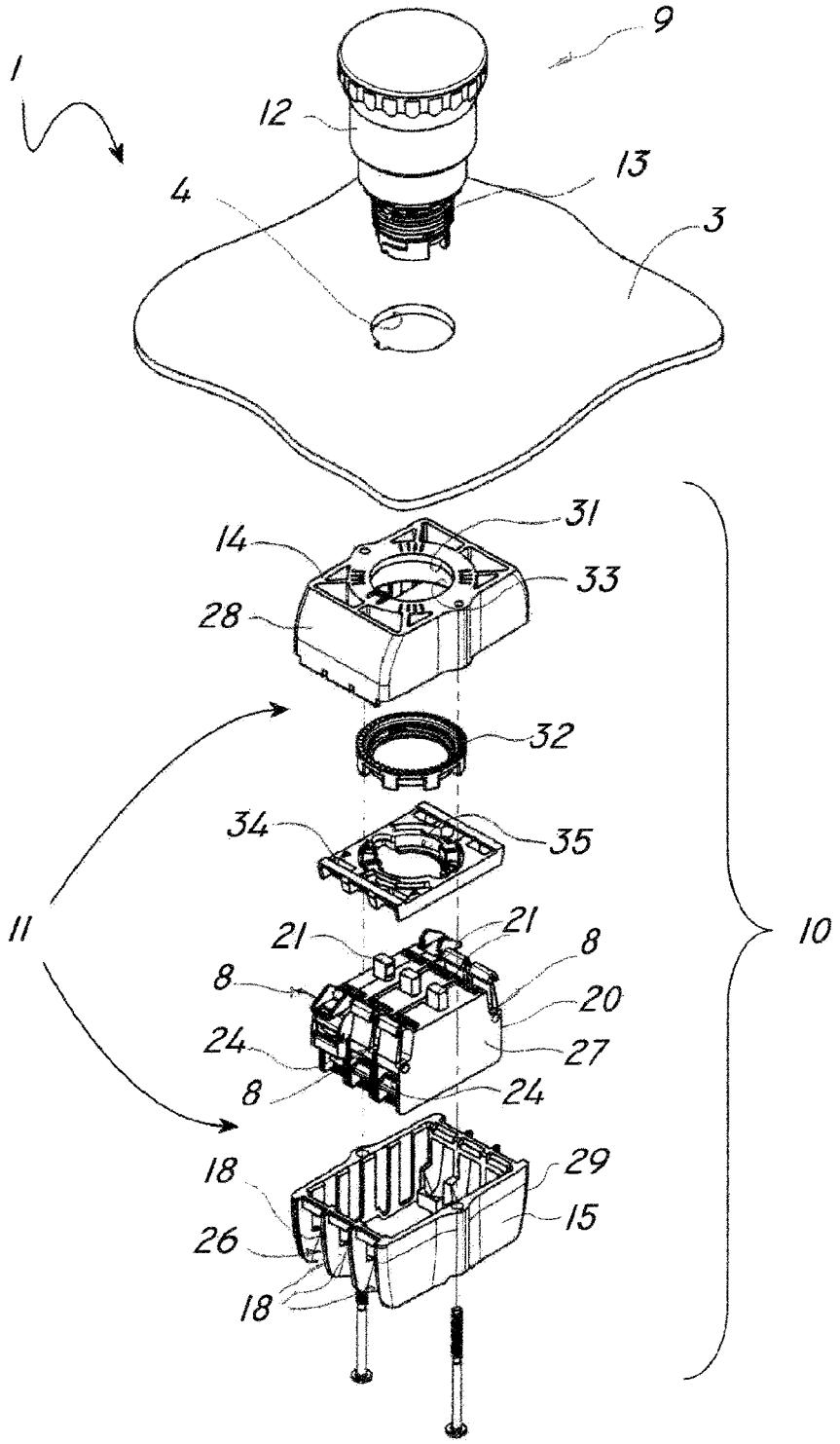
FIG. 2 is an enlarged view of the apparatus of FIG. 1 with certain elements being omitted.
Figure 3:
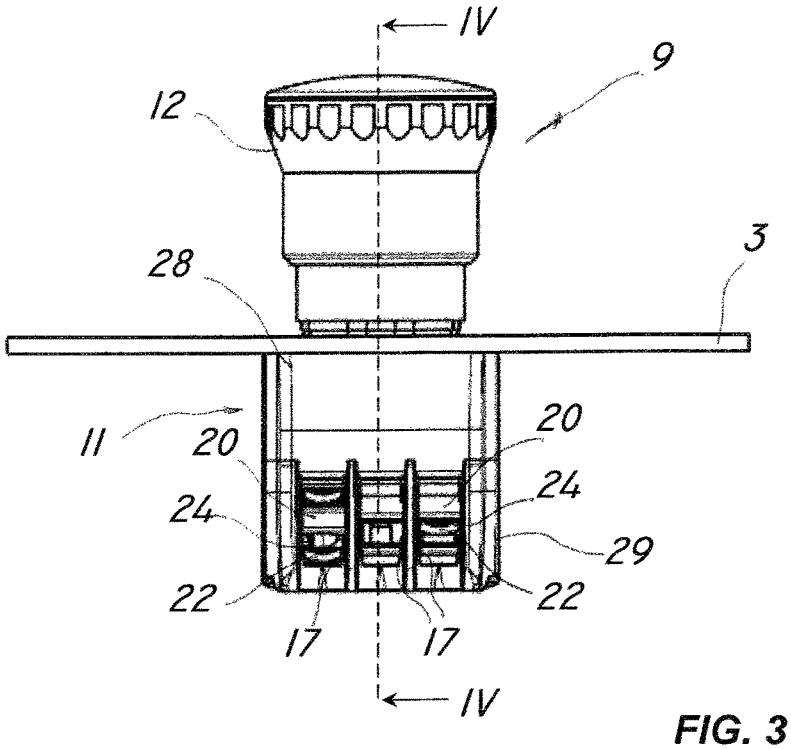
FIG. 3 is a side view of a detail of the apparatus of FIG. 1 in an assembled state.
Figure 4:
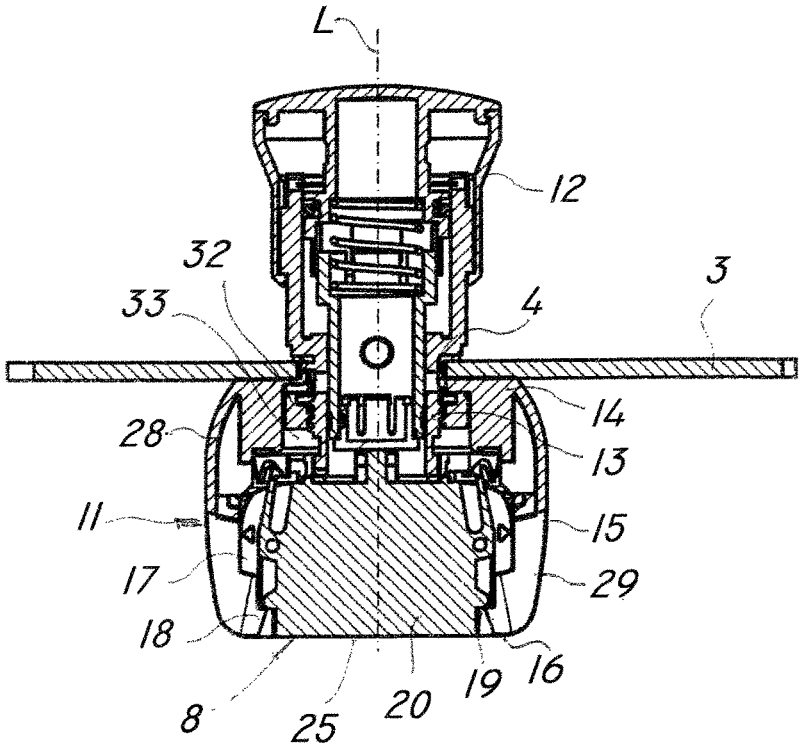
FIG. 4 is a sectional view of the detail of FIG. 3, as taken along a plane IV-IV.

Particularly, FIG. 1 shows an apparatus of the control pushbutton station type, generally referenced 1, which has a box-like body 2 adapted for anchorage to a fixed or movable part of an electric plant, not shown and known per se, and having a closing panel 3 with a passage 4 formed therethrough.

In the illustrated embodiment, the box-like body 2 has a lower container portion 5, which may be anchored in a known manner to a fixed or movable support of the plant or to a suspension cable for the passage of electric cables, and an upper closing cover 6, which is adapted to be stably and removably coupled to the lower portion 5 by first screw means 7 or the like, to define a closed box-like body 2.

Here, the passage 4 is formed on the upper wall of the cover 6 that comprises said closing panel 3, in a substantially central position.

The box-like body 2 houses one or more switch contact units 8 arranged at the passage 4 and adapted to be electrically connected to respective electric circuits of the plant, that may be power and/or service circuits, for selective opening/closing thereof.

The switch units 8 are adapted to interact with a corresponding actuator 9 operating along a longitudinal axis L and partially inserted in the passage 4 to promote the mutual movement of the fixed and movable contacts and cause selective opening/closing of the electric circuit connected to the contact units 8, in a known manner, that will not be described in further detail below.

The one or more switch units 8 and the respective actuator 9 are joined together by anchor means 10 which, according to a peculiar characteristic of the invention, include a container member 11 that is adapted to be anchored to the closing panel or cover 3 and to envelope and contain the one or more contact units 8 to stably secure them to the actuator 9.

This will prevent mutual disengagement thereof due to impacts on the box-like body 2 and/or the contact units 8 themselves.

In a preferred arrangement, the actuator 9 has an outer portion 12 that is designed to be actuated by a user, and an inner portion 13 that is designed to be inserted in the passage 4 for engagement of one or more respective contact units 8.

FIGS. 1 to 5 show a control pushbutton station 1 having a single actuator 9 that consists of a common emergency button, i.e. of the type that can be actuated by a translational motion or by a rotational and translational motion.

Nevertheless, as more clearly described below, the actuator 9 may be any actuator that is typically used in this kind of apparatus, with no particular limitation, and may be selected, for instance, from the group comprising emergency buttons, selectors, actuator buttons, directional buttons or the like.

Furthermore, the apparatus 1 of the invention may be a pushbutton station having a plurality of such actuators 9, possibly differing from one another, and designed to be inserted in respective passages in the panel or closing cover 3 to interact with respective one or more contact units 8.

In this case, a container member 11 may be provided for one or more of such actuators 9, to envelope and contain the corresponding contact units 8.

Also, in a further configuration, not shown in the annexed figures, the apparatus 1 may be a control switchboard having a box-like body adapted to be anchored to a fixed or movable support of the plant, with the closing panel being hinged thereto.

The container member 11 is substantially of the box- or cage-like type, and may be made of any polymeric material that can ensure adequate resistance as well as relative light weight and cost-effectiveness, such as glass-filled nylon.

Particularly, the container member 11 has a substantially flat upper wall 14 which is designed to be placed in facing relationship to the closing panel 3 and a sidewall 15 that is closed at its bottom by a substantially flat bottom wall 16.

Thus, the container member 11 will define therein one or more housings 17 in side-by-side and transversely juxtaposed relationship, to retain respective contact units 8 and prevent displacement thereof in either longitudinal and transverse directions.

Furthermore, the side wall 15 of the container member 11 has substantially longitudinal inwardly-extending ribs 18, for separating the various housings 17.

Figure 7:
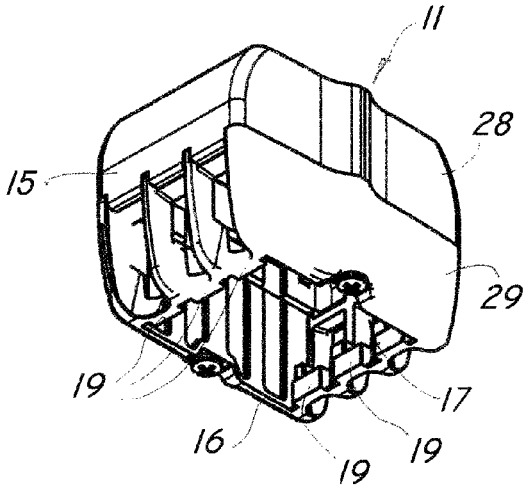
Figure 8:
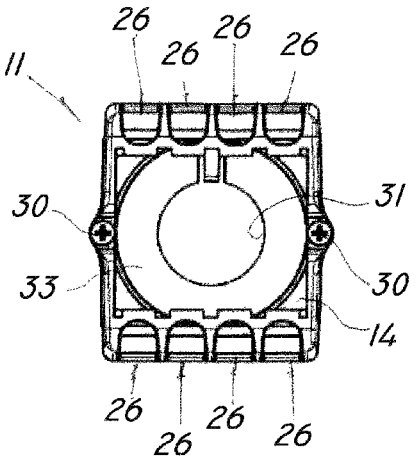
FIG. 8 is a bottom view of the container member of FIG. 1, in a second configuration.

The bottom wall 16 of the container member 11 is substantially open with substantially transverse abutments surfaces 19, as more clearly shown in FIGS. 7, 8, with the contact units 8 being laid thereupon.

Figure 6:
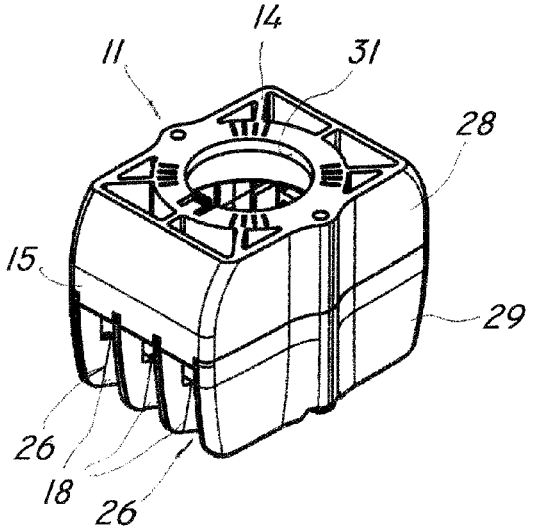
FIGS. 6 and 7 are perspective top and bottom views respectively of a container member that is part of the inventive apparatus, in a first preferred configuration.

FIGS. 6 and 7 show a container member 11 having three substantially similar housings 17, for simultaneously receiving up to three contact units 8, not necessarily of the same type, which are designed to interact with a single actuator 9.

Figure 9:
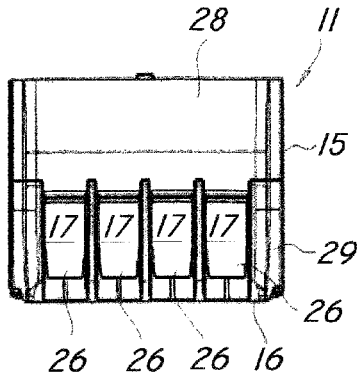
FIG. 9 is a side view of the element of FIG. 8.

On the other hand, FIGS. 8 and 9 show a container member 11 having four substantially similar housings 17, for simultaneously receiving up to four contact units 8, not necessarily of the same type, which are designed to interact with a single actuator 9.

Therefore, there is no particular restriction about the number of housings 17, that may change according to functional requirements and to the size of the box-like body 2.

The contact units 8 are of known type and essentially include an insulating case 20 of such a size as to fit into a respective housing 17 with a substantially tight fit or with a very small clearance.

The insulating case 20 houses one or more pairs of movable contacts, not shown, which are adapted to interact with the actuator 9. e.g. via a slider 21 that moves longitudinally in the case 20, and to cooperate with respective pairs of fixed contacts, also not shown.

For example, one or two pairs of fixed contacts may be provided, to define a switch contact unit 8 of single- or double-contact type respectively. The fixed contacts have respective terminals 22 for connection to the terminals of respective electric circuits.

The case 20 has first openings 23 for access to the terminals 22 and second openings 24 for receiving the terminals of the electric circuits, in view of connecting the contact units 8.

Figure 5:
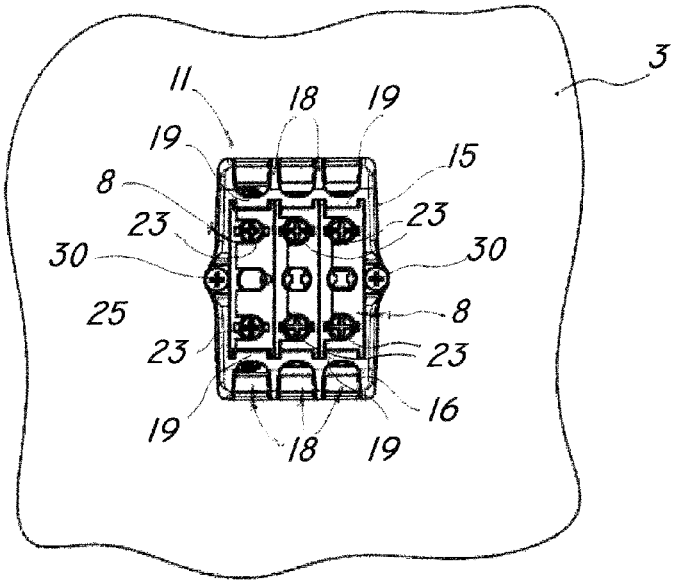
FIG. 5 is a bottom view of the detail of FIG. 3.

As is known in the art, the first access openings 23 may be arranged in the bottom wall 25 of the case 20, as shown in FIG. 5, and the terminals 22 are accommodated in respective hollow seats that may possibly contain a lock screw or the like, the latter being adapted to be actuated by an ordinary screwdriver through the partially open bottom wall 16 of the container member 11.

Alternatively and in a known manner, this terminal 22 may also be a spring terminal, of the type having solder pins and configured according to any other common use in the field.

Conveniently, the bottom wall 16 of the container member 11 is open at least at said first openings 23 or has first peripheral passages that face corresponding first openings 23 of the case 20.

Advantageously, the side wall 15 of the container member 11 has a plurality of second peripheral passages 26 that face corresponding second openings 24 of the case 20.

Thus, the contact units 8 can be also wired while being fitted in stable positions in the container member 11, which will considerably simplify installation, as well as any required maintenance.

Furthermore, if the contact units 8 have first openings 23 for access to the terminals 22 arranged on the side wall 27 of their respective case 20, access thereto will be allowed by the second passages 26.

Preferably, the container member 11 includes a pair of half-shells, i.e. an upper half-shell 28 and a lower half-shell 29, which are removably secured to each other, e.g. without limitation by second screw means 30 or equivalent removable connector means.

The upper half-shell 28 is adapted to be removably anchored to the inner portion 13 of the actuator 9 and has a substantially central hole 31 that can be longitudinally aligned in substantially coaxial fashion with the passage 4 of the cover 6, for the actuator 9 and the contact units 8 to be coupled together.

On the other hand, the lower half-shell 29 has both the first passages, or the at least partially open bottom wall 16, and the second peripheral passages 26.

The anchor means 10 include a locking nut 32, which is adapted to be held within an annular seat 33 that is formed in the upper wall 14 of the container member 11 and is disposed at the periphery of the central hole 31 thereof to be tightened on an externally threaded surface of the inner portion 13 of the actuator 9.

Furthermore, a connecting plate 34 may be also provided, which is designed for snap connection with the contact units 8 and has a central access 35 for the passage of the actuating sliders 21 that actuate the contact units 8 and for interaction with the actuator 9.

Figure 10:
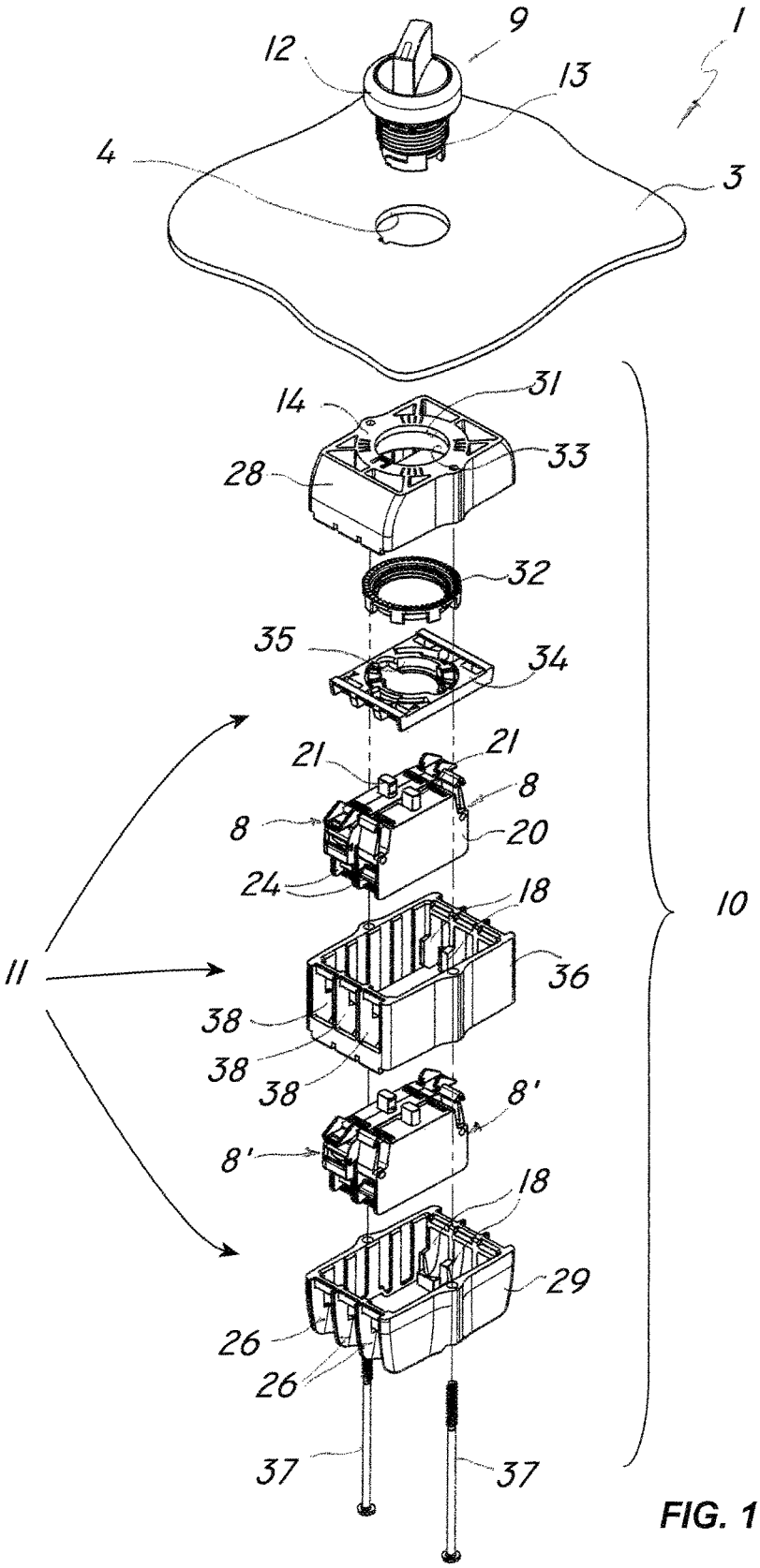
FIG. 10 is a partial exploded perspective view of an apparatus of the invention in a third preferred configuration and having a container member in a second preferred configuration.

FIG. 10 shows a detail of a switch apparatus 1 of the invention in a second preferred configuration, also concerning a control pushbutton station. Particularly, the apparatus 1 has a single actuator 9 which is defined, in this case, by a selector.

Furthermore, the container member 11 includes a central extension portion 36, which has a substantially rectangular tubular shape, and is adapted to be interposed between the two half-shells 28, 29 and to be coupled thereto via third screw means 37 of appropriate size.

This allows one or more of the housings 17 to accommodate respective pairs of contact units 8, 8', which are mutually joined and longitudinally aligned, as also shown in FIG. 10. The number of housings 17 may be also changed as needed.

Figure 11:
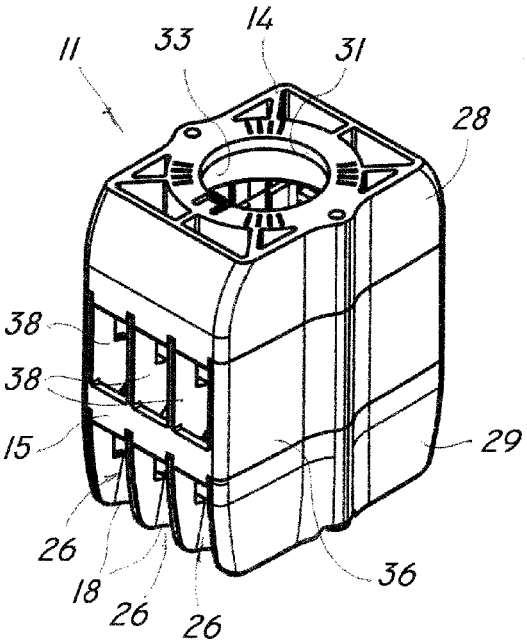
FIGS. 11 and 12 are perspective top and bottom views respectively of the container member in the third preferred configuration.
Figure 12:
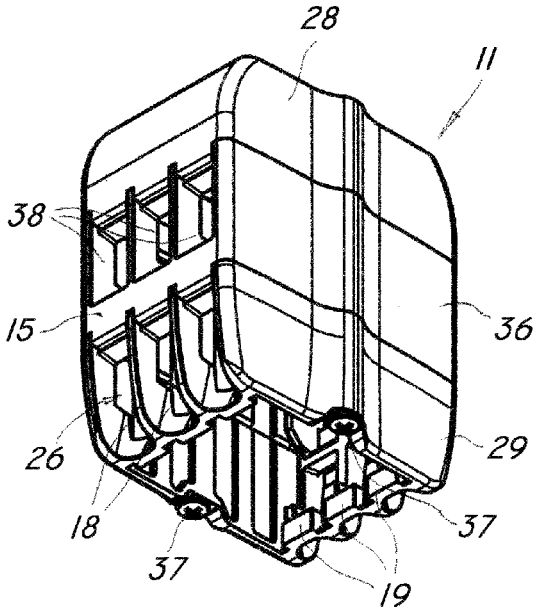

In a particularly advantageous aspect of the invention, as more clearly shown in FIGS. 11 and 12, the extension portion 36 has third peripheral passages 38, longitudinally aligned with respective second passages 26 of the second half-shell 29, allowing access to first and/or second openings 23, 24 of corresponding contact units 8.

This will provide the apparatus 1 with a high functional versatility, due to the typical modularity of switch contact units, and will constantly ensure utmost positional stability.

The above disclosure clearly shows that the present invention fulfills the intended objects and particularly meets the requirement of providing a switch control device that ensures high positional stability of the switch control units accommodated therein.

The apparatus of this invention is susceptible of a number of changes and variants, within the inventive principle disclosed in the appended claims. All the details thereof may be replaced by other technically equivalent parts, and the materials may vary depending on different needs, without departure from the scope of the invention.

While the apparatus has been described with particular reference to the accompanying figures, the numerals referred to in the disclosure and claims are only used for the sake of a better intelligibility of the invention and shall not be intended to limit the claimed scope in any manner.

The invention claimed is:

1. A switch control apparatus for electric plants, comprising:

a box-shaped body (2) adapted to be anchored to a fixed or movable part of an electric plant and having a closing panel (3) provided with at least one passage (4);

at least one contact unit (8) housed into said box-shaped body (2) at said passage (4) and adapted to be electrically connected to at least one respective electric circuit of the plant to control a selective opening/closing thereof;

at least one actuator (9) adapted to interact with said at least one contact unit (8) to promote a selective opening/closing of the respective circuits thereby; and means (10) for anchoring said at least one contact unit (8) to said actuator (9);

wherein said anchoring means (10) comprise a containment member (11) adapted to contain said at least one contact unit (8) and anchorable to said closing panel (3) into said box-shaped body (2) for stably securing said at least one contact unit (8) on said actuator (9), and wherein said containment member (11) is substantially box-shaped and envelopes said at least one contact unit (8), said containment member (11) having an upper wall (14) adapted to face said closing panel (3) and a side wall (15) extending from an entire perimeter of said upper wall (14) and closed by a planar bottom wall (16) to define one or more adjacent housings (17) adapted to hold respective contact units (8), said bottom wall (16) having an opening that provides access to said contact units (8).

2. The switch control apparatus as claimed in claim 1, wherein said bottom wall (16) of the containment member (11) has transverse abutment surfaces (19) for supporting the contact units (8).

3. The switch control apparatus as claimed in claim 2, wherein said at least one contact unit (8) comprises an insulating case (20) adapted to be inserted in a substantially precise manner in a respective housing (17).

4. The switch control apparatus as claimed in claim 3, wherein said insulating case (20) houses fixed contacts provided with connecting terminals (22) for connecting with the electric circuits and movable contacts adapted to interact along a longitudinal axis (L) with said actuator (9) and to cooperate with corresponding fixed contacts, said case (20) having first openings (23) for access to said terminals (22) and second openings (24) for connecting ends of the electric circuits with said fixed contacts.

5. The switch control apparatus as claimed in claim 4, wherein said bottom wall (17) of said containment member (11) is at least partially open and/or is provided with a plurality of first peripheral passages facing corresponding first openings (23) of said case (20).

6. The switch control apparatus as claimed in claim 5, wherein said side wall (15) of said containment member (11) comprises a plurality of second peripheral passages (26) facing corresponding second openings (24) of said case (20).

7. The switch control apparatus as claimed in claim 6, wherein said actuator (9) has an outer portion (12) adapted to be actuated by a user and an inner portion (13) adapted to be inserted into said box-shaped body (2) through said passage (4) to engage said at least one contact unit (8), said upper wall (14) of said containment member (11) having a substantially central through hole (31) adapted to be longitudinally aligned with said passage (4).

8. The switch control apparatus as claimed in claim 7, wherein said containment member (11) comprises an upper half-shell (28) and a lower half-shell (29) reciprocally and removably anchorable and respectively provided with said central through hole (31) and with said first and second peripheral passages (26).

9. A switch control apparatus for electric plants, comprising:

a box-shaped body (2) adapted to be anchored to a fixed or movable part of an electric plant and having a closing panel (3) provided with at least one passage (4);

at least one contact unit (8) housed into said box-shaped body (2) at said passage (4) and adapted to be electrically connected to at least one respective electric circuit of the plant to control a selective opening/closing thereof;

at least one actuator (9) adapted to interact with said at least one contact unit (8) to promote a selective opening/closing of the respective circuits thereby; and means (10) for anchoring said at least one contact unit (8) to said actuator (9);

wherein said anchoring means (10) comprise a containment member (11) adapted to envelope and contain said at least one contact unit (8) and anchorable to said closing panel (3) into said box-shaped body (2) for stably securing said at least one contact unit (8) on said actuator (9), wherein said containment member (11) is substantially box-shaped with an upper wall (14) adapted to face said closing panel (3) and a side wall (15) closed by a substantially planar bottom wall (16) to define one or more adjacent housings (17) adapted to hold respective contact units (8), wherein said at least one contact unit (8) comprises an insulating case (20) adapted to be inserted in a substantially precise manner in a respective housing (17), wherein said insulating case (20) houses fixed contacts provided with connecting terminals (22) for connecting with the electric circuits and movable contacts adapted to interact along a longitudinal axis (L) with said actuator (9) and to cooperate with corresponding fixed contacts, said case (20) having first openings (23) for access to said terminals (22) and second openings (24) for connecting ends of the electric circuits with said fixed contacts, wherein said bottom wall (17) of said containment member (11) is at least partially open and/or is provided with a plurality of first peripheral passages facing corresponding first openings (23) of said case (20), wherein said side wall (15) of said containment member (11) comprises a plurality of second peripheral passages (26) facing corresponding second openings (24) of said case (20), wherein said actuator (9) has an outer portion (12) adapted to be actuated by a user and an inner portion (13) adapted to be inserted into said box-shaped body (2) through said passage (4) to engage said at least one contact unit (8), said upper wall (14) of said containment member (11) having a substantially central through hole (31) adapted to be longitudinally aligned with said passage (4), wherein said containment member (11) comprises an upper half-shell (28) and a lower half-shell (29) reciprocally and removably anchorable and respectively provided with said central through hole (31) and with said first and second peripheral passages (26), and wherein said containment member (11) comprises a hollow intermediate extension portion (36) adapted to be interposed between said upper half-shell (28) and said lower half-shell (29) for housing pairs of contact units (8, 8') reciprocally joined and longitudinally aligned, said extension portion (36) having third peripheral passages (38) longitudinally aligned with corresponding second passages (26) of said lower half-shell (29).

10. The switch control apparatus as claimed in claim 9, wherein said anchoring means (10) comprise a locking nut (32) adapted to be housed in an annular seat (33) located peripherally to said central hole (31) of said containment member (11) to be screwed on a threaded surface of said inner portion (13) of said actuator (9).

* * * * *